US010954765B2

(12) United States Patent
Trautman et al.

(10) Patent No.: US 10,954,765 B2
(45) Date of Patent: Mar. 23, 2021

(54) HYDROCARBON RESOURCE HEATING SYSTEM INCLUDING INTERNAL FLUIDIC CHOKE AND RELATED METHODS

(71) Applicant: EAGLE TECHNOLOGY, LLC, Melbourne, FL (US)

(72) Inventors: Mark A. Trautman, Melbourne, FL (US); Verlin A. Hibner, Melbourne Beach, FL (US); Brian N. Wright, Indialantic, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 170 days.

(21) Appl. No.: 16/221,931

(22) Filed: Dec. 17, 2018

(65) Prior Publication Data

US 2020/0190953 A1 Jun. 18, 2020

(51) Int. Cl.
*E21B 43/24* (2006.01)
*E21B 36/04* (2006.01)

(52) U.S. Cl.
CPC ..... *E21B 43/2401* (2013.01); *E21B 36/04* (2013.01)

(58) Field of Classification Search
CPC ..... E21B 36/04; E21B 43/2401
See application file for complete search history.

(56) References Cited

U.S. PATENT DOCUMENTS 5,065,819 A 11/1991 Kasevich
7,441,597 B2 10/2008 Kasevich
7,891,421 B2 2/2011 Kasevich
8,876,814 B2 11/2014 Bonn
9,157,305 B2 10/2015 Dittmer et al.
9,328,593 B2 5/2016 Wright
9,441,472 B2 9/2016 Wright et al.
9,739,126 B2 8/2017 Trautman et al.
9,784,083 B2 10/2017 Trautman et al.
2010/0078163 A1 4/2010 Banerjee et al.
2010/0294488 A1 11/2010 Wheeler et al.
2010/0294489 A1 11/2010 Dreher, Jr. et al.
2015/0129222 A1* 5/2015 Wright ..... E21B 43/2401 166/302
2015/0211336 A1* 7/2015 Wright ..... E21B 43/24 166/302

(Continued)

OTHER PUBLICATIONS

U.S. Appl. No. 16/177,695, filed Nov. 1, 2018 Trautman et al.

*Primary Examiner* — Caroline N Butcher
(74) *Attorney, Agent, or Firm* — Allen, Dyer, Doppelt + Gilchrist, P.A.

(57) ABSTRACT

A system for heating a hydrocarbon resource in a subterranean formation having a wellbore extending therein may include a radio frequency (RF) source, and a casing within the wellbore including electrically conductive pipes with a dielectric heel isolator coupled between adjacent electrically conductive pipes. Electrically conductive pipes from among the plurality thereof and downstream from the dielectric heel isolator define an RF antenna. The system may further include an RF transmission line extending within the casing and coupled between the RF source and RF antenna, a seal between the RF transmission line and adjacent portions of the casing adjacent the dielectric heel isolator to define an internal choke fluid chamber upstream of the seal, and an electrically conductive choke fluid contained within the internal choke fluid chamber.

23 Claims, 5 Drawing Sheets

(56) References Cited

U.S. PATENT DOCUMENTS

2016/0160622 A1* 6/2016 Trautman ..... E21B 36/04
166/302
2016/0160623 A1* 6/2016 White ..... E21B 43/2401
166/272.6

* cited by examiner

HYDROCARBON RESOURCE HEATING SYSTEM INCLUDING INTERNAL FLUIDIC CHOKE AND RELATED METHODS

TECHNICAL FIELD

The present invention relates to the field of hydrocarbon resource recovery, and, more particularly, to hydrocarbon resource recovery using RF heating.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same effect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Despite the existence of systems that utilize RF energy to provide heating, such systems suffer from the inevitable high degree of electrical near field coupling that exists between the radiating antenna element and the transmission line system that delivers the RF power to the antenna, resulting in common mode current on the outside of the transmission line. Left unchecked, this common mode current heats unwanted areas of the formation, effectively making the transmission line part of the radiating antenna.

One system which may be used to help overcome this problem is disclosed in U.S. Pat. No. 9,441,472 to Wright et al, which is also assigned to the present Applicant and is hereby incorporated herein in its entirety by reference. This reference discloses a system for heating a hydrocarbon resource in a subterranean formation having a wellbore extending therein which includes a radio frequency (RF) antenna configured to be positioned within the wellbore, an RF source, a cooling fluid source, and a transmission line coupled between the RF antenna and the RF source. A plurality of ring-shaped choke cores may surround the transmission line, and a sleeve may surround the ring-shaped choke cores and define a cooling fluid path for the ring-shaped choke cores in fluid communication with the cooling fluid source.

Still another advantageous configuration is set forth in U.S. Pat. No. 9,784,083 to Trautman et al. This patent discloses a system for heating a hydrocarbon resource in a subterranean formation having a wellbore extending therein and includes an RF source, a choke fluid source, and an elongate RF antenna configured to be positioned within the wellbore and coupled to the RF source, with the elongate RF antenna having a proximal end and a distal end separated from the proximal end. The system also includes a choke fluid dispenser coupled to the choke fluid source and positioned to selectively dispense choke fluid into adjacent portions of the subterranean formation at the proximal end of the RF antenna to define a common mode current choke at the proximal end of the RF antenna.

Despite the advantages of such systems, further approaches to common mode current mitigation may be desirable in some circumstances.

SUMMARY

A system for heating a hydrocarbon resource in a subterranean formation having a wellbore extending therein may include a radio frequency (RF) source, and a casing within the wellbore and comprising a plurality of electrically conductive pipes and a dielectric heel isolator coupled between adjacent electrically conductive pipes, with electrically conductive pipes from among the plurality thereof and downstream from the dielectric heel isolator defining an RF antenna. The system may further include an RF transmission line extending within the casing and coupled between the RF source and RF antenna, a seal between the RF transmission line and adjacent portions of the casing adjacent the dielectric heel isolator to define an internal choke fluid chamber upstream of the seal, and an electrically conductive choke fluid contained within the internal choke fluid chamber.

More particularly, the internal choke fluid chamber may have an open end opposite the seal. Moreover, the system may also include a controllable gas pressure source in fluid communication with the open end of the internal choke fluid chamber to regulate a pressure of the electrically conductive choke fluid. By way of example, the controllable gas pressure source may comprise a controllable nitrogen gas source.

The RF transmission line may comprise a coaxial RF transmission line including an inner conductor and an outer conductor surrounding the inner conductor. Furthermore, the system may also include a feed section dielectric isolator between adjacent electrically conductive pipes so that the RF antenna comprises an RF dipole antenna. The RF antenna may extend horizontally within the subterranean formation, for example, and the system may also include a producer well below the RF antenna within the subterranean formation. By way of example, the electrically conductive choke fluid may comprise saline water.

A related method is for making a radio frequency RF heater for heating a hydrocarbon resource in a subterranean formation having a wellbore extending therein. The method may include positioning a casing within the wellbore and comprising a plurality of electrically conductive pipes with a dielectric heel isolator coupled between adjacent electrically conductive pipes, with electrically conductive pipes from among the plurality thereof and downstream from the dielectric heel isolator defining an RF antenna. The method may further include positioning an RF transmission line and associated seal within the casing and coupled between an RF source and the RF antenna so that the seal is between the RF transmission line and adjacent portions of the casing adjacent the dielectric heel isolator to define an internal choke fluid chamber upstream of the seal, and filling the internal choke fluid chamber with an electrically conductive choke fluid.

DETAILED DESCRIPTION OF THE EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
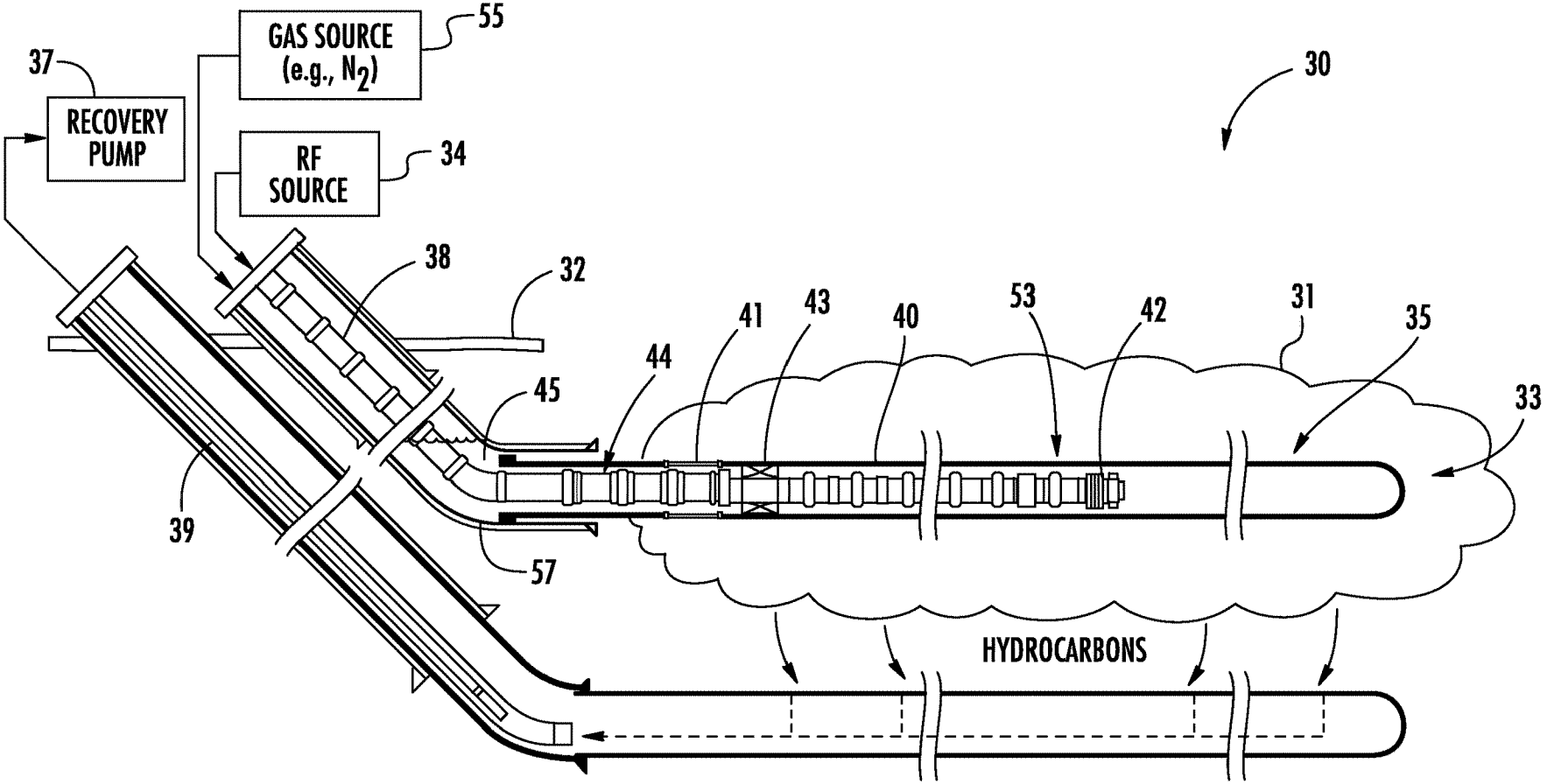
FIG. 1 is a schematic block diagram of a system for heating a hydrocarbon resource in a subterranean formation in accordance with an example embodiment.
Figure 2:
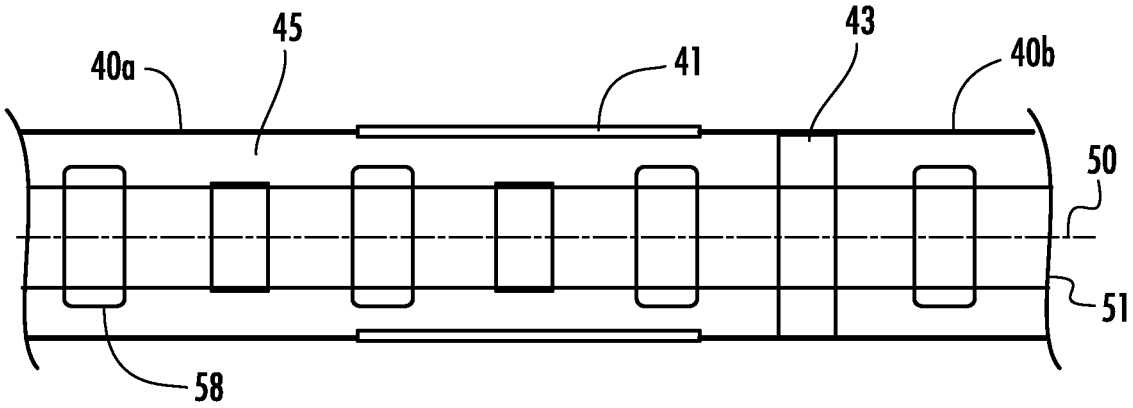
FIG. 2 is a schematic cross-sectional view of the internal fluid choke chamber of the system of FIG. 1.

Referring initially to FIGS. 1-2, a system 30 for heating a hydrocarbon resource 31 in a subterranean formation 32 having a wellbore 33 therein is first described. In the illustrated example, the wellbore 33 is a laterally or horizontally extending wellbore within the "payzone" of the subterranean formation 32 where the hydrocarbon resource 31 (e.g., petroleum, bitumen, oil sands, etc.) is located. The system 30 further illustratively includes a radio frequency (RF) source 34 for an RF antenna or transducer 35 that is positioned in the wellbore 33 adjacent the hydrocarbon resource 31. The RF source 34 is illustratively positioned above the subterranean formation 32, and may be an RF power generator, for example. In an example implementation, the laterally extending wellbore 33 may extend several hundred meters (or more) within the subterranean formation 32. Moreover, a typical laterally extending wellbore may have a diameter of about fourteen inches or less, although larger wellbores may be used in some implementations.

In the illustrated example, a second or producing wellbore 36 is positioned below the upper RF wellbore 33 for collecting petroleum, bitumen, etc., released from the subterranean formation 32 through RF heating. A recovery pump 37 is coupled to tubing 39 extending within the wellbore 36 through which hydrocarbons are recovered. The recovery pump 37 may be a submersible pump, for example, and positioned within the electrically conductive well pipe of the second wellbore 36, or it may be outside of the wellbore at the wellhead as in the illustrated embodiment. By way of example, the recovery pump 37 may be an artificial gas lift (AGL), or other type of pump, using hydraulic or pneumatic lifting techniques. Although not shown, in some embodiments a solvent may be injected into the formation 32 via the upper or lower wellbores 33, 34 in a similar fashion to the configurations described in U.S. Pat. No. 9,739,126 to Trautman et al. or U.S. patent application Ser. No. 16/177,695 filed Nov. 1, 2018, both of which are assigned to the present Applicant and hereby incorporated herein in their entireties by reference.

A casing 40 extends within the upper wellbore 33 which includes a plurality of interconnected electrically conductive pipes (such as the pipes 40*a*, 40*b* shown in FIG. 2). A dielectric heel isolator 41 is coupled between adjacent electrically conductive pipes in the casing 40, so that the electrically conductive pipes downstream from the dielectric heel isolator define the RF antenna 35. An RF transmission line 38 extends within the upper wellbore 33 between the RF source 34 and the RF antenna 35. A plurality of centralizers 58 may be positioned on the RF transmission line 38. The RF antenna 35 is configured to heat the subterranean formation 32 based upon RF power from the RF source 34. In the illustrated example, the RF transmission line 38 is a coaxial RF transmission line including an inner conductor 50 and an outer conductor 51 surrounding the inner conductor. An RF feed section 42 connects the RF transmission line 38 with the downstream portion of the casing 40. A feed section dielectric isolator 53 is also coupled between adjacent electrically conductive pipes so that the RF antenna 35 is an RF dipole antenna, although other antenna configurations may be used in different embodiments.

The RF source 34 may be used to differentially drive the RF antenna 35. That is, the RF antenna 35 may have a balanced design that may be driven from an unbalanced drive signal. Typical frequency range operation for a subterranean heating application may be in a range of about 100 kHz to 10 MHz, and at a power level of several megawatts, for example. However, it will be appreciated that other configurations and operating values may be used in different embodiments. Further details on an exemplary antenna structure which may be used with the embodiments provided herein are set forth in U.S. Pat. No. 9,328,593, which is also assigned to the present Applicant and is hereby incorporated herein in its entirety by reference.

As noted above, electromagnetic (EM) fields radiated from the antenna 35 may induce currents that can travel along the outside of the transmission line back 38 to surface. The transmission line 38 effectively becomes an extension of the radiating antenna 35. This stray energy does not heat the hydrocarbon payzone, and creates inefficiency in the RF power delivery.

To help address these problems associated with common mode currents being transmitted back up the transmission line 38 toward the surface, a seal 43 is positioned between the RF transmission line 38 and adjacent portions of the casing 40 adjacent the dielectric heel isolator 41 to define an internal choke fluid chamber 44 upstream of the seal (i.e., between seal and the surface). The internal choke fluid chamber 44 may then be filled with an electrically conductive choke fluid 45, such as saline water. As such, the dissipative fluid surrounds the transmission line 38 and is contained inside the casing 40 to advantageously provide common mode suppression of currents that result from feeding the RF antenna 35. More particularly, the internal choke fluid chamber 44 may be used to confine much of the current to the RF antenna 35, rather than allowing it to travel back up the outer conductor 51 of the RF transmission line 38, for example, to thereby help maintain volumetric heating in the desired location while enabling efficient, and electromagnetic interference (EMI) compliant operation.

In the illustrated example, the internal choke fluid chamber 44 has an open end opposite the seal 43, although in some embodiments another seal may be positioned upstream of the seal 43 within the wellbore 33 if desired. In either case, an optional controllable gas pressure source 55 (e.g., a nitrogen gas source or other inert gas source) may be connected in fluid communication with the internal choke fluid chamber 44 to regulate a pressure of the electrically conductive choke fluid. The controllable gas pressure source 55 may accordingly be used to adjust the boiling point (i.e., phase change temperature) of the dissipative fluid within the internal choke fluid chamber 44. For example, using a saline solution as the choke fluid, setting a gas pressure to 1 ATM within the internal choke fluid chamber 44 changes the boiling temperature of the solution from 200° C. to around 100° C. Changing the boiling point of the choke fluid 45 advantageously allows for adjustment to provide evaporative cooling at a desired set point.

Choking the RF field induces power dissipation in the dissipative choke fluid 45. At low power dissipation, heat will be moved from the dissipative choke region to the surrounding formation 32 by natural convection. More particularly, at high power dissipation heat will be moved from the internal choke fluid chamber 44 through boiling/condensation to the surrounding earth like a thermosiphon.

Figure 3:
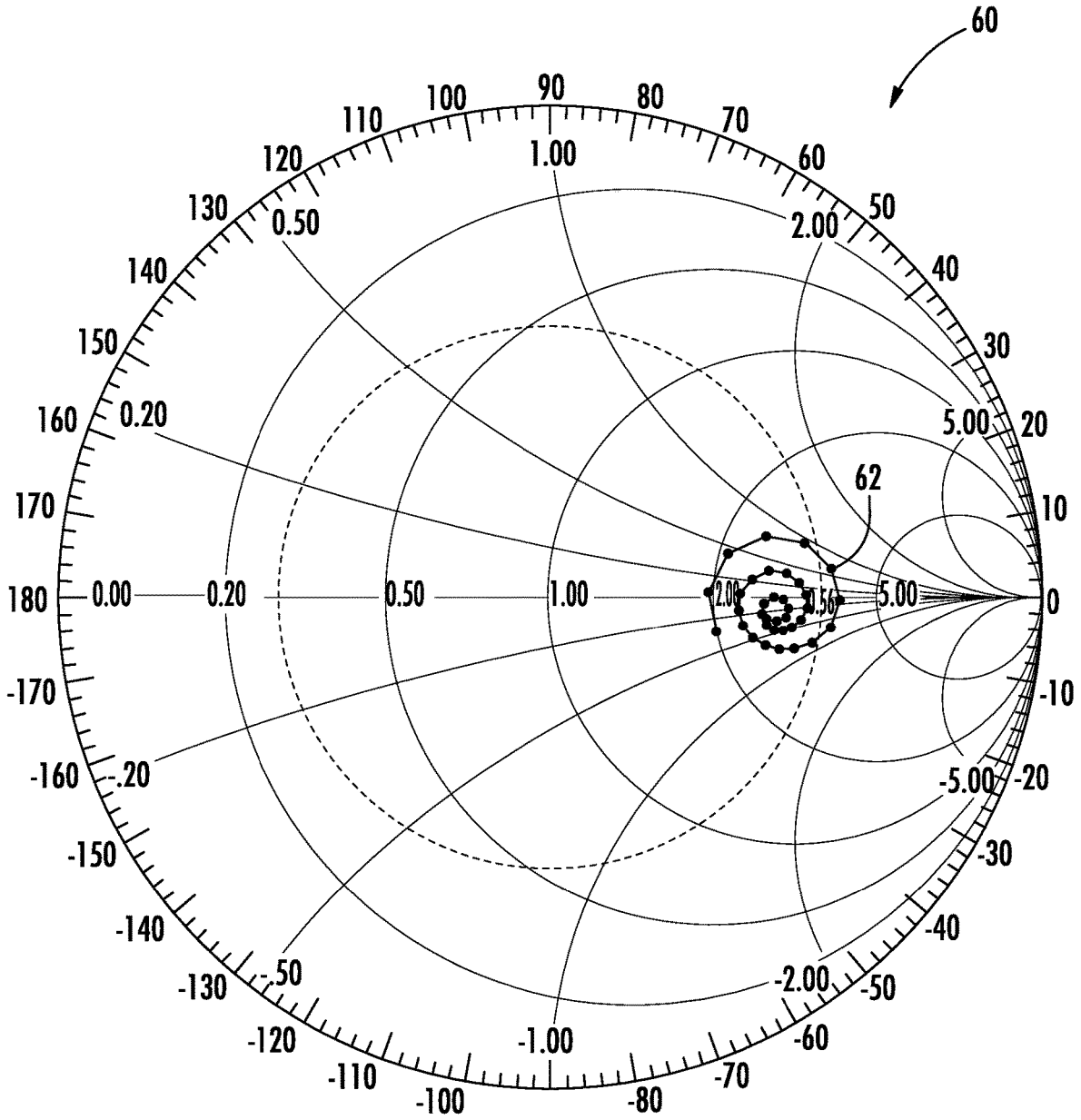
FIG. 3 is an impedance plot for the antenna of FIG. 1 with the associated internal fluid choke.
Figure 4:
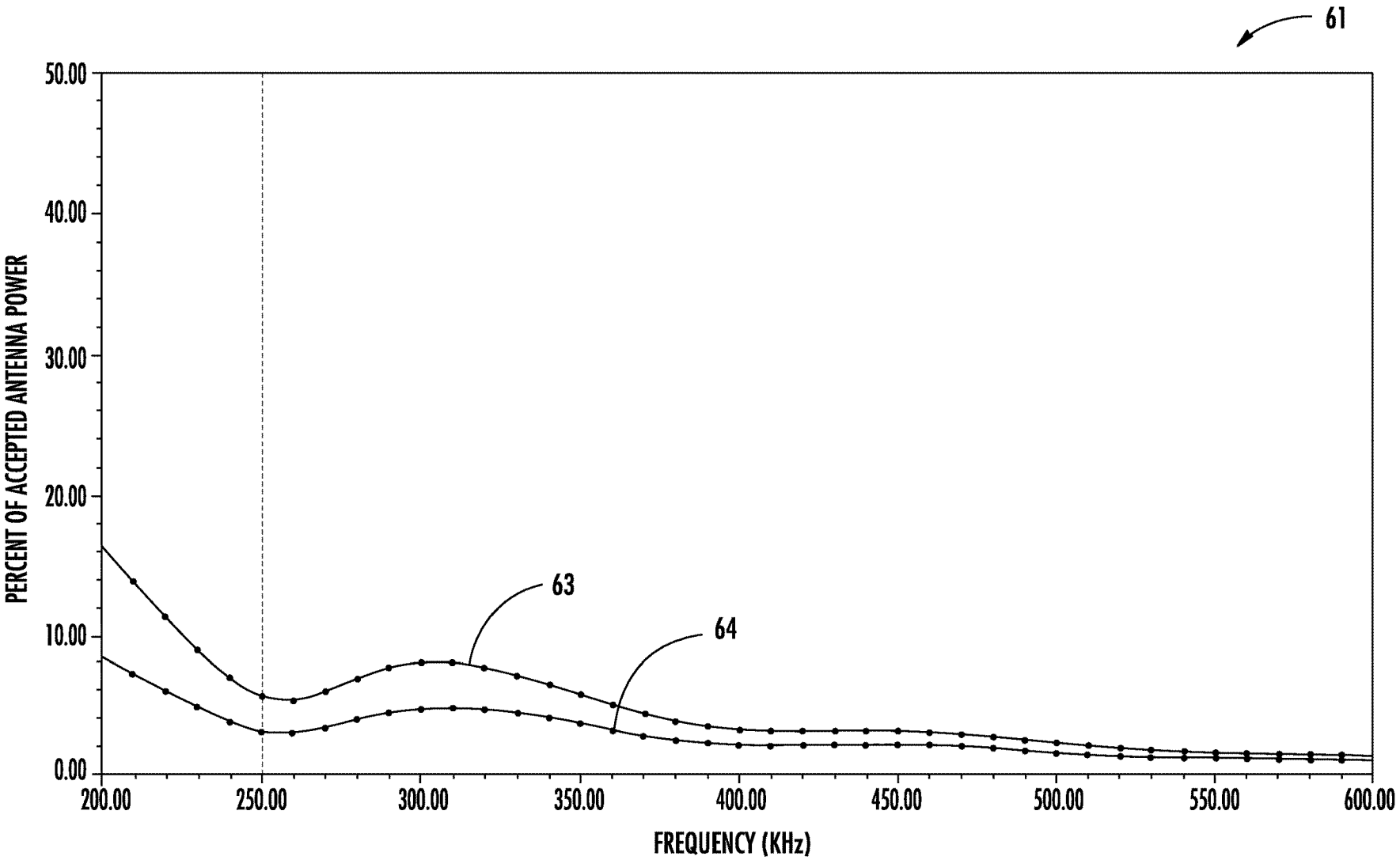
FIG. 4 is a graph of the percent of accepted antenna power vs. frequency for the antenna of FIG. 2 with the associated internal fluid choke.

Referring to the graphs 60, 61 of FIGS. 3 and 4, simulated results of the system 30 with internal choke fluid chamber 44 are now described. The simulation was for an 800 m antenna with an impedance of 75 Ohms, a choke fluid (here saline water) conductivity of 30 S/m, and a reservoir conductivity of 0.003 S/m. The plot line 62 demonstrates the antenna impedance over a sweep of 200 to 800 KHz in 10 KHz steps. The plot line 63 is simulated power dissipation in the internal choke fluid, and the plot line 64 represents simulated power dissipation in the geographical formation 32 outside of the payzone. The simulation results show that the power dissipated in the internal choke fluid chamber 44 is frequency dependent.

The internal choke fluid chamber 44 is a closed system which does not require the replacement or replenishment of dissipative fluid. As such, the system 30 provides for relative simplicity of operation, in that only a single charge of choke fluid is required in some embodiments. Moreover, this configuration advantageously provides for passive operation in a highly controlled environment internal to the casing 40, while still providing broad band choke performance. Another advantage of the internal choke fluid chamber 44 configuration is that it may advantageously reduce the diameter of the casing 40, which may provide for significant cost savings over well lengths that can span hundreds of meters.

Furthermore, this configuration does not require active cooling or additional plumbing, which may be the case with magnetic or resonant balun styles of choke. However, it should be noted that in some embodiments such chokes may also be used in addition to the internal choke fluid chamber 44 if desired, and could be used to provide cooling for such chokes as well. Additionally, the internal choke fluid chamber 44 configuration has an added benefit of providing cooling for the heel dielectric isolator 41 by adjusting operating pressure and saturation temperature. As a result, this may remove a significant heating load (and cost), which would otherwise have to be cooled from the surface while providing the ability to run the system 30 hotter (e.g., greater than 160° C.)

In some embodiments, the internal choke fluid chamber 44 configuration may advantageously allow for increased transmission line impedance (Zo), which may in turn help to reduce transmission line losses and further increase system efficiency. Another advantage of the internal choke fluid chamber 44 is that it lessens sensitivity to high reservoir conductivity compared to magnetic chokes, which may accordingly provide increased flexibility to operate in higher conductivity formations if necessary.

Figure 5:
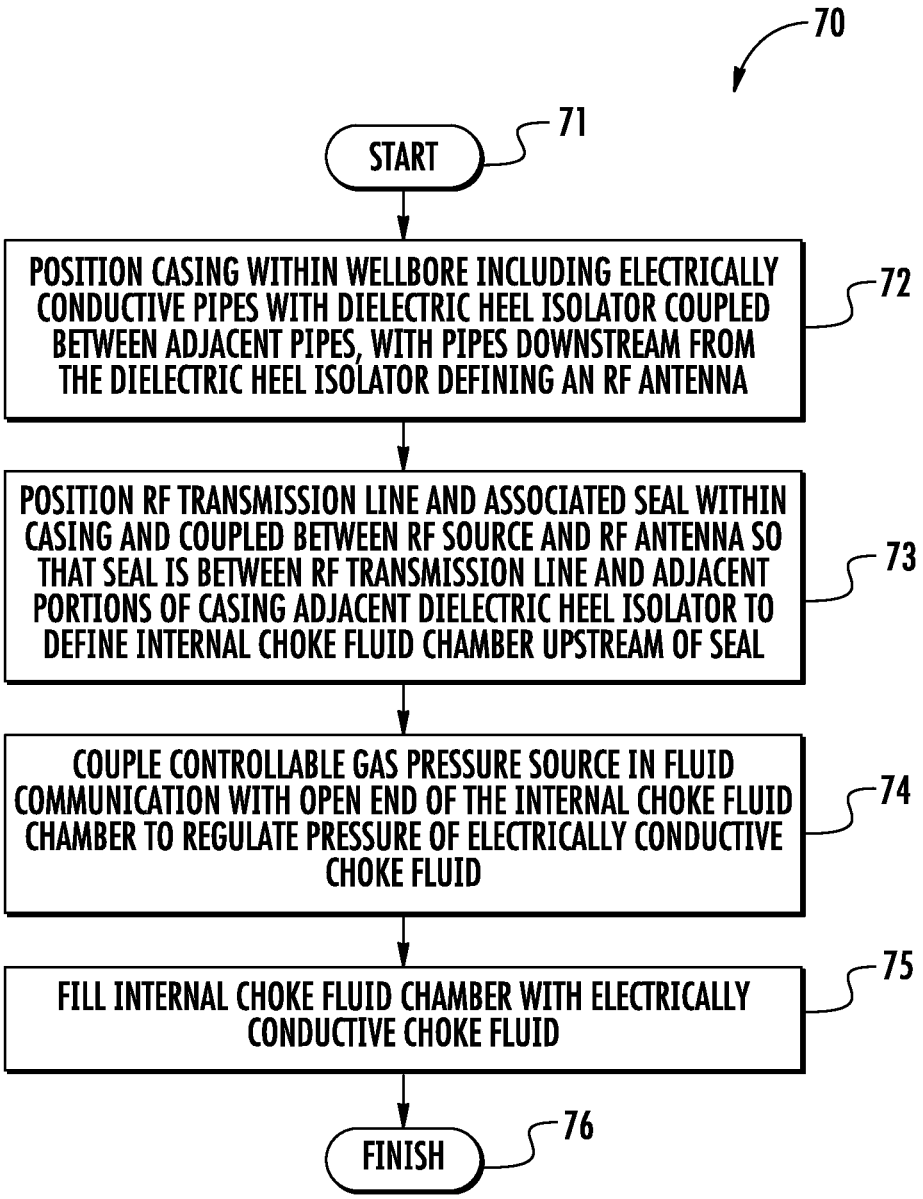
FIG. 5 is a flow diagram illustrating a method of making the RF heating system of FIG. 1.

Turning now to FIG. 5, a related method for making a radio frequency RF heater system 30 for heating the hydrocarbon resource 31 in the subterranean formation 32 is now described. Beginning at Block 71, the method illustratively includes positioning the casing 40 within the wellbore 33 (Block 72) by coupling together a plurality of electrically conductive pipes with a dielectric heel isolator 41 coupled between adjacent electrically conductive pipes and feeding them down the wellbore. As noted above, the electrically conductive pipes downstream from the dielectric heel isolator 41 (i.e., between the dielectric heel isolator and the end of the well) define the RF antenna 35. In some implementations, a well liner 57 may optionally be positioned within the wellbore 33 depending on the composition of the subterranean formation 32. The method further illustratively includes positioning an RF transmission line 38 and associated seal 43 within the casing 40 and coupled between the RF 34 source and the RF antenna 35 so that the seal is between the RF transmission line and adjacent portions of the casing adjacent the dielectric heel isolator 41 to define an internal choke fluid chamber 44 upstream of the seal, as noted above (Block 73).

A controllable gas pressure source 55 may optionally be coupled in fluid communication with the internal choke fluid chamber 44 to regulate pressure of the electrically conductive choke fluid 45 (Block 74), as also discussed above. The method further illustratively includes filling the internal choke fluid chamber 44 with an electrically conductive choke fluid 45, at Block 75, at which point operation of the RF antenna 35 may commence followed by production of hydrocarbons from the producer well 36. The method of FIG. 6 illustratively concludes at Block 76.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating a hydrocarbon resource in a subterranean formation having a wellbore extending therein, the system comprising:

a radio frequency (RF) source;

a casing within the wellbore, the casing comprising a plurality of electrically conductive pipes and a dielectric heel isolator coupled between adjacent electrically conductive pipes, with electrically conductive pipes from among the plurality thereof and downstream from the dielectric heel isolator defining an RF antenna;

an RF transmission line extending within the casing and coupled between the RF source and RF antenna;

a seal between the RF transmission line and adjacent portions of the casing adjacent the dielectric heel isolator to define an internal choke fluid chamber upstream of the seal; and an electrically conductive choke fluid contained within the internal choke fluid chamber.

2. The system of claim 1 wherein the internal choke chamber has an open end opposite the seal.

3. The system of claim 2 further comprising a controllable gas pressure source in fluid communication with the open end of the internal choke fluid chamber to regulate a pressure of the electrically conductive choke fluid.

4. The system of claim 3 wherein the controllable gas pressure source comprises a controllable nitrogen gas source.

5. The system of claim 1 wherein the RF transmission line comprises a coaxial RF transmission line comprising an inner conductor and an outer conductor surrounding the inner conductor.

6. The system of claim 1 further comprising a feed section dielectric isolator coupled between adjacent electrically conductive pipes from among the plurality of electrically conductive pipes downstream from the dielectric heel isolator defining the RF antenna so that the RF antenna comprises an RF dipole antenna.

7. The system of claim 1 wherein the RF antenna extends horizontally within the subterranean formation.

8. The system of claim 7 further comprising a producer well below the RF antenna within the subterranean formation.

9. The system of claim 1 wherein the electrically conductive choke fluid comprises saline water.

10. A system for heating a hydrocarbon resource in a subterranean formation having a wellbore extending therein, the system comprising:

a radio frequency (RF) source;

a casing within the wellbore, the casing comprising a plurality of electrically conductive pipes and a dielectric heel isolator coupled between adjacent electrically conductive pipes, with electrically conductive pipes from among the plurality thereof and downstream from the dielectric heel isolator defining an RF antenna extending horizontally within the subterranean formation;

an RF transmission line extending within the casing and coupled between the RF source and RF antenna;

a seal between the RF transmission line and adjacent portions of the casing adjacent the dielectric heel isolator to define an internal choke fluid chamber upstream of the seal having an open end opposite the seal; and an electrically conductive choke fluid contained within the internal choke fluid chamber.

11. The system of claim 10 further comprising a controllable gas pressure source in fluid communication with the open end of the internal choke fluid chamber to regulate a pressure of the electrically conductive choke fluid.

12. The system of claim 11 wherein the controllable gas pressure source comprises a controllable nitrogen gas source.

13. The system of claim 10 wherein the RF transmission line comprises a coaxial RF transmission line comprising an inner conductor and an outer conductor surrounding the inner conductor.

14. The system of claim 10 further comprising a feed section dielectric isolator coupled between adjacent electrically conductive pipes from among the plurality of electrically conductive pipes downstream from the dielectric heel isolator defining the RF antenna so that the RF antenna comprises an RF dipole antenna.

15. The system of claim 10 further comprising a producer well below the RF antenna within the subterranean formation.

16. The system of claim 10 wherein the electrically conductive choke fluid comprises saline water.

17. A method for making a radio frequency RF heater for heating a hydrocarbon resource in a subterranean formation having a wellbore extending therein, the method comprising:

positioning a casing within the wellbore, the casing comprising a plurality of electrically conductive pipes and a dielectric heel isolator coupled between adjacent electrically conductive pipes, with electrically conductive pipes from among the plurality thereof and downstream from the dielectric heel isolator defining an RF antenna;

positioning an RF transmission line and associated seal within the casing and coupled between an RF source and the RF antenna so that the seal is between the RF transmission line and adjacent portions of the casing adjacent the dielectric heel isolator to define an internal choke fluid chamber upstream of the seal; and filling the internal choke fluid chamber with an electrically conductive choke fluid.

18. The method of claim 17 wherein the internal choke chamber has an open end opposite the seal.

19. The method of claim 18 further comprising coupling a controllable gas pressure source in fluid communication with the open end of the internal choke fluid chamber to regulate a pressure of the electrically conductive choke fluid.

20. The method of claim 17 wherein the RF transmission line comprises a coaxial RF transmission line comprising an inner conductor and an outer conductor surrounding the inner conductor.

21. The method of claim 17 further comprising coupling a feed section dielectric isolator between adjacent electrically conductive pipes from among the plurality of electrically conductive pipes downstream from the dielectric heel isolator defining the RF antenna so that the RF antenna defines an RF dipole antenna.

22. The method of claim 17 wherein the RF antenna extends horizontally within the subterranean formation.

23. The method of claim 17 wherein the electrically conductive choke fluid comprises saline water.

* * * * *